US007731632B2

(12) United States Patent
Wu

(10) Patent No.: US 7,731,632 B2
(45) Date of Patent: Jun. 8, 2010

(54) ROTATABLE ROCK CLIMBING PRACTICE DEVICE

(76) Inventor: Yu-Feng Wu, No. 133-12A. Anhe Rd., Situn District, Taichung City (TW) 407

( * ) Notice: Subject to any disclaimer, the term of this patent is extended or adjusted under 35 U.S.C. 154(b) by 0 days.

(21) Appl. No.: 12/398,104

(22) Filed: Mar. 4, 2009

(65) Prior Publication Data

US 2010/0016126 A1 Jan. 21, 2010

Related U.S. Application Data

(63) Continuation-in-part of application No. 12/173,435, filed on Jul. 15, 2008, now abandoned.

(51) Int. Cl.
*A63B 7/04* (2006.01)
*A63B 9/00* (2006.01)

(52) U.S. Cl. ..... 482/37; 482/51

(58) Field of Classification Search ..... 482/35, 482/36, 37, 23, 38, 51, 52, 69; 198/150, 198/151, 850, 832.2, 832.3; 434/247, 255, 434/256; 472/44, 45

See application file for complete search history.

(56) References Cited

U.S. PATENT DOCUMENTS

| | | | | |
|---|---|---|---|---|
| 4,726,581 | A * | 2/1988 | Chang | 482/53 |
| 5,125,877 | A * | 6/1992 | Brewer | 482/7 |
| 5,328,420 | A * | 7/1994 | Allen | 482/52 |
| 5,328,422 | A * | 7/1994 | Nichols | 482/52 |
| 5,352,166 | A * | 10/1994 | Chang | 482/52 |
| 5,549,195 | A * | 8/1996 | Aulagner et al. | 198/850 |
| 5,556,352 | A * | 9/1996 | Chang | 482/52 |
| 5,919,117 | A * | 7/1999 | Thompson et al. | 482/37 |
| 6,231,482 | B1 * | 5/2001 | Thompson | 482/37 |
| 7,510,511 | B2 * | 3/2009 | von Detten | 482/54 |

FOREIGN PATENT DOCUMENTS

| | | | |
|---|---|---|---|
| DE | 19935868 | A1 * | 2/2001 |
| DE | 10235148 | A1 * | 2/2004 |
| FR | 2713098 | A1 * | 6/1995 |
| GB | 2260912 | A * | 5/1993 |
| GB | 2424597 | A * | 10/2006 |
| JP | 10277189 | A * | 10/1998 |

* cited by examiner

*Primary Examiner*—Loan H Thanh
*Assistant Examiner*—Daniel F Roland
(74) *Attorney, Agent, or Firm*—Wang Law Firm, Inc.; Li K. Wang

(57) ABSTRACT

A rock climbing practice device includes a body which is rotatable 360 degrees about an axle support by a support unit. The body has multiple climbing surfaces and side surfaces, and multiple climbing holds are connected to the climbing surfaces which are formed along the rotational direction of the body. A shaft is connected to the support unit and co-rotated with the axle. A damping unit is connected to the shaft so as to provide proper damping force to the body and an adjustment unit is connected to the damping unit to adjust the damping force. When climbers climb the body which is rotated due to the weight of the climbers and the rotated body provides the climbing surfaces at different inclinations.

6 Claims, 10 Drawing Sheets

ROTATABLE ROCK CLIMBING PRACTICE DEVICE

This is a Continuation-In-Part of a co-pending U.S. patent application Ser. No. 12/173,435 filed on Jul. 15, 2008.

FIELD OF THE INVENTION

Background of the Invention

A conventional rock climbing practice device 9 is shown in FIG. 11 and generally includes a support base 91 and a rectangular frame 92 has two sides thereof pivotably connected to the support base 91. The frame 92 includes an endless surface 93 which is driven by a motor and the endless surface 93 is composed of multiple elongate boards 931. The boards 931 have climbing holds 932 connected thereon so that the climber can climb the rock climbing practice device 9 upward by grabbing the climbing holds. Because the endless surface 93 is driven by the motor so that the climber actually is located at a fixed height from the floor and the number and shape of the climbing holds 932 are continuously changed along with the movement of the endless surface. The endless surface 93 may also be rotated by the weight of the climbers without using the motor.

This rock climbing practice device 9 is suitable for beginners and the climbing holds 932 are located at the straight surface of the endless surface 93. The frame 92 can pivot about the pivot points on two sides thereof so as to simulate the inclination of real rock climbing in wild.

Nevertheless, the rock climbing practice device 9 cannot meet different requirements of different levels of climbers and the climbers feel boring quickly. This is because the climbing holds 932 are located on the endless surface 93 which is a two dimensional surface.

The present invention intends to provide a rock climbing practice device which is a body with multiple side surfaces and climbing surfaces and the body is pivotable 360 degrees about an axle. The climbing surfaces have climbing holds connected thereto. A damping device is provided to reduce the speed of the rotation of the body. When climbing the climbing device, the body is rotated due to the weight of the climbers such that inclinations of the climbing surfaces are similar to natural rock climbing site.

SUMMARY OF THE INVENTION

The present invention relates to a rock climbing practice device which comprises a body having multiple side surfaces and climbing surfaces, and an angle is defined between adjacent climbing surfaces/side surfaces so as to form a three dimensional body. An axle extends through two opposite sides of the body and multiple climbing holds are connected to the climbing surfaces. A support unit supports the axle and the body is rotatable about the axle relative to the support unit. The climbers climb on inclined climbing surfaces of the body to practice higher of climbing skill.

The speed of the rotation of the body can be controlled by a damping unit and an adjustment unit which controls the damping unit. The damping unit provides proper damping force to control the speed of rotation of the body, and this allows the climbers of different levels to use the rock climbing device.

The body of the rock climbing practice device is composed of multiple cubic units which are able to change the shape of the body to provide different levels of climbing conditions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
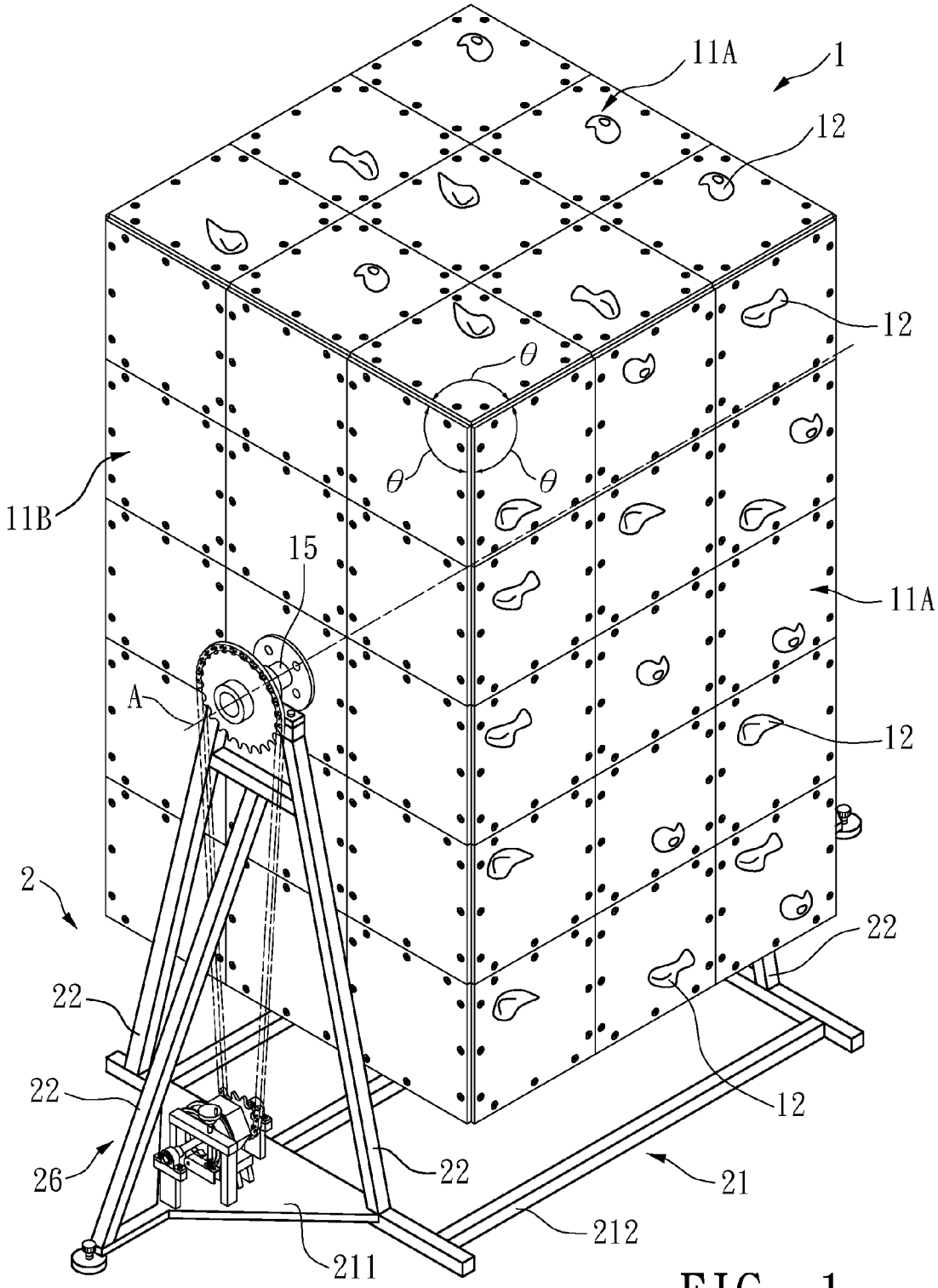
FIG. 1 is a perspective view to show the rock climbing device of the present invention.
Figure 2:
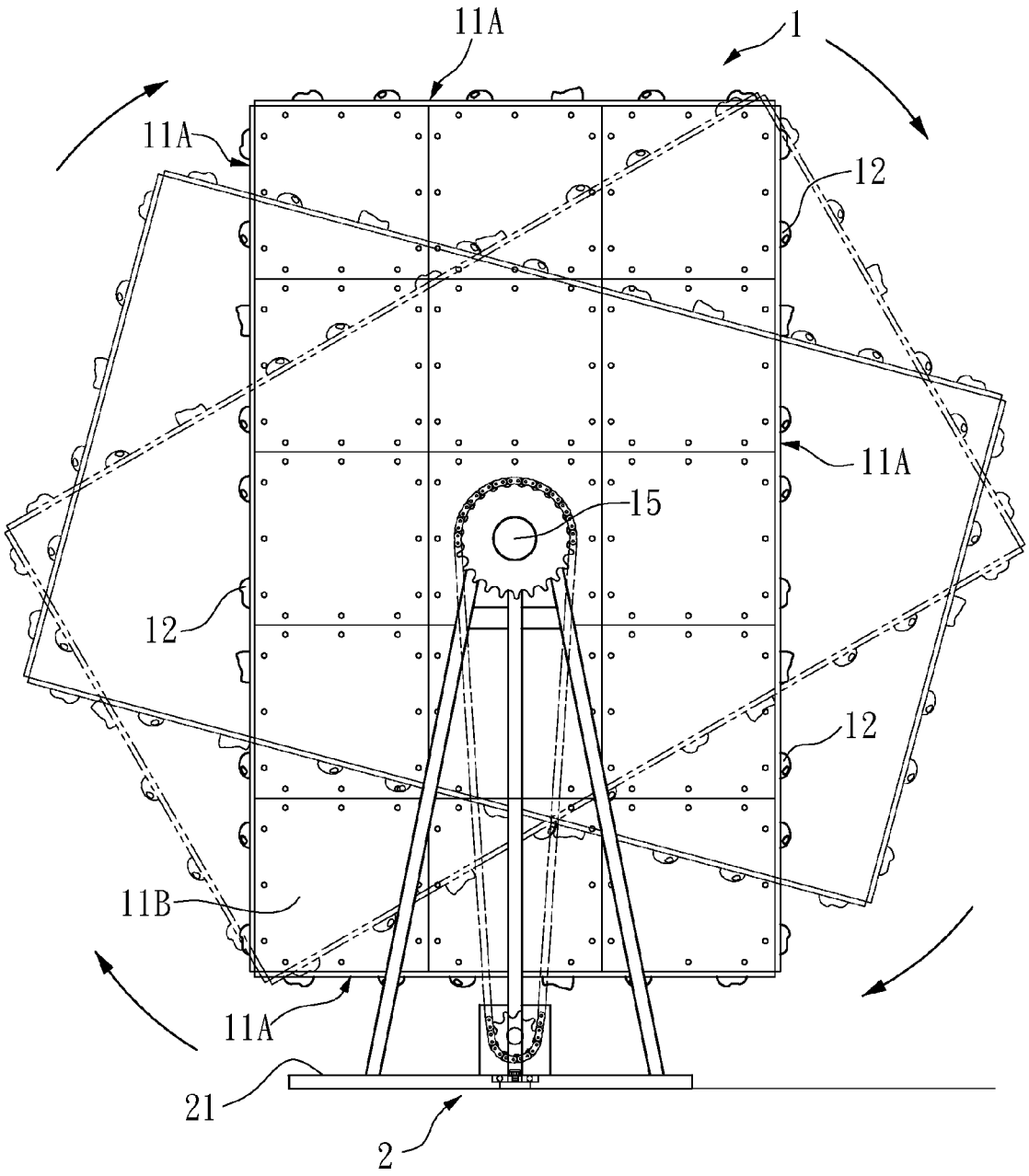
FIG. 2 shows that the body of the rock climbing practice device of the present invention is rotatable about the axle.
Figure 3:
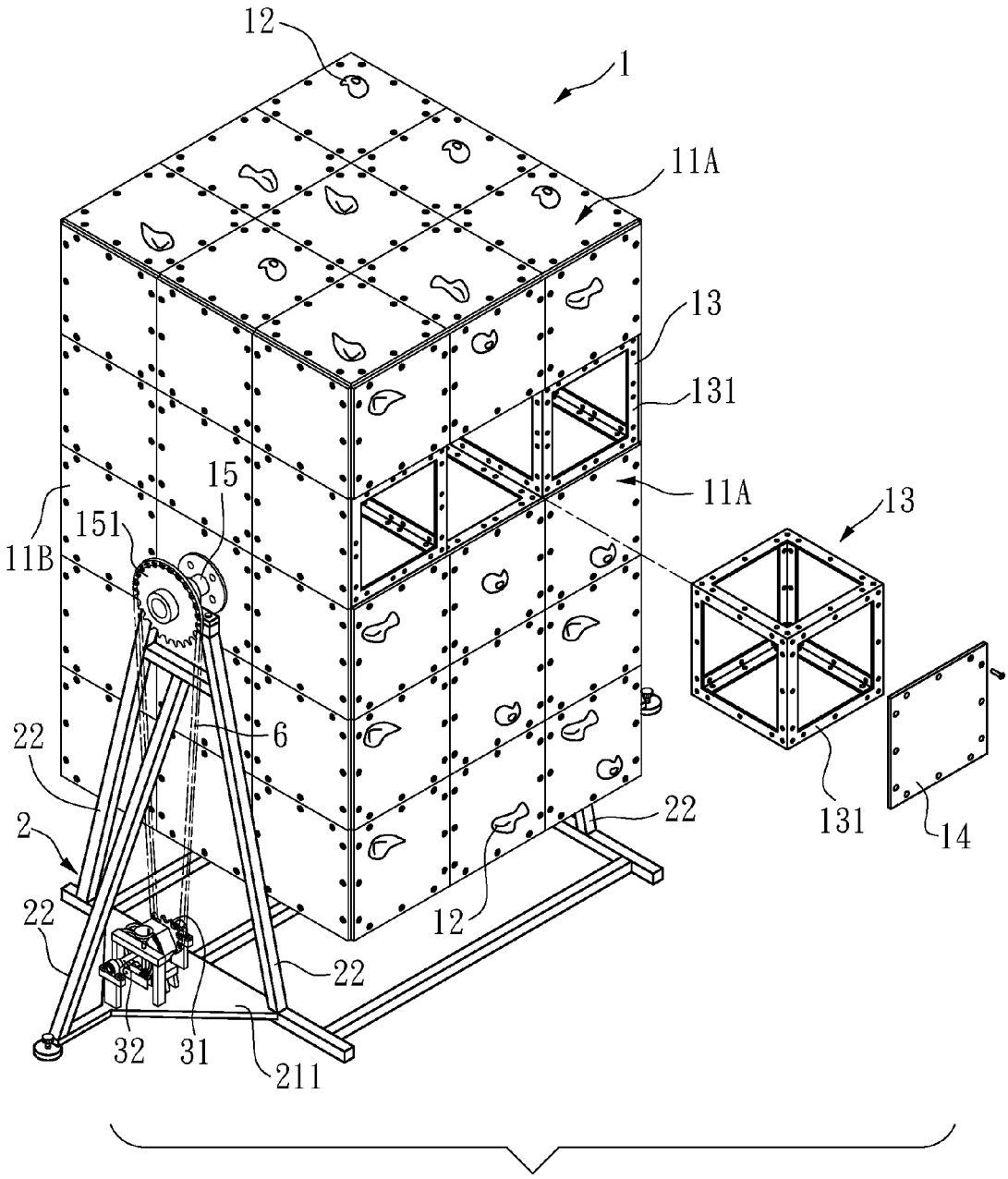
FIG. 3 shows that the body of the rock climbing practice device of the present invention is composed of multiple cubic units.
Figure 4:
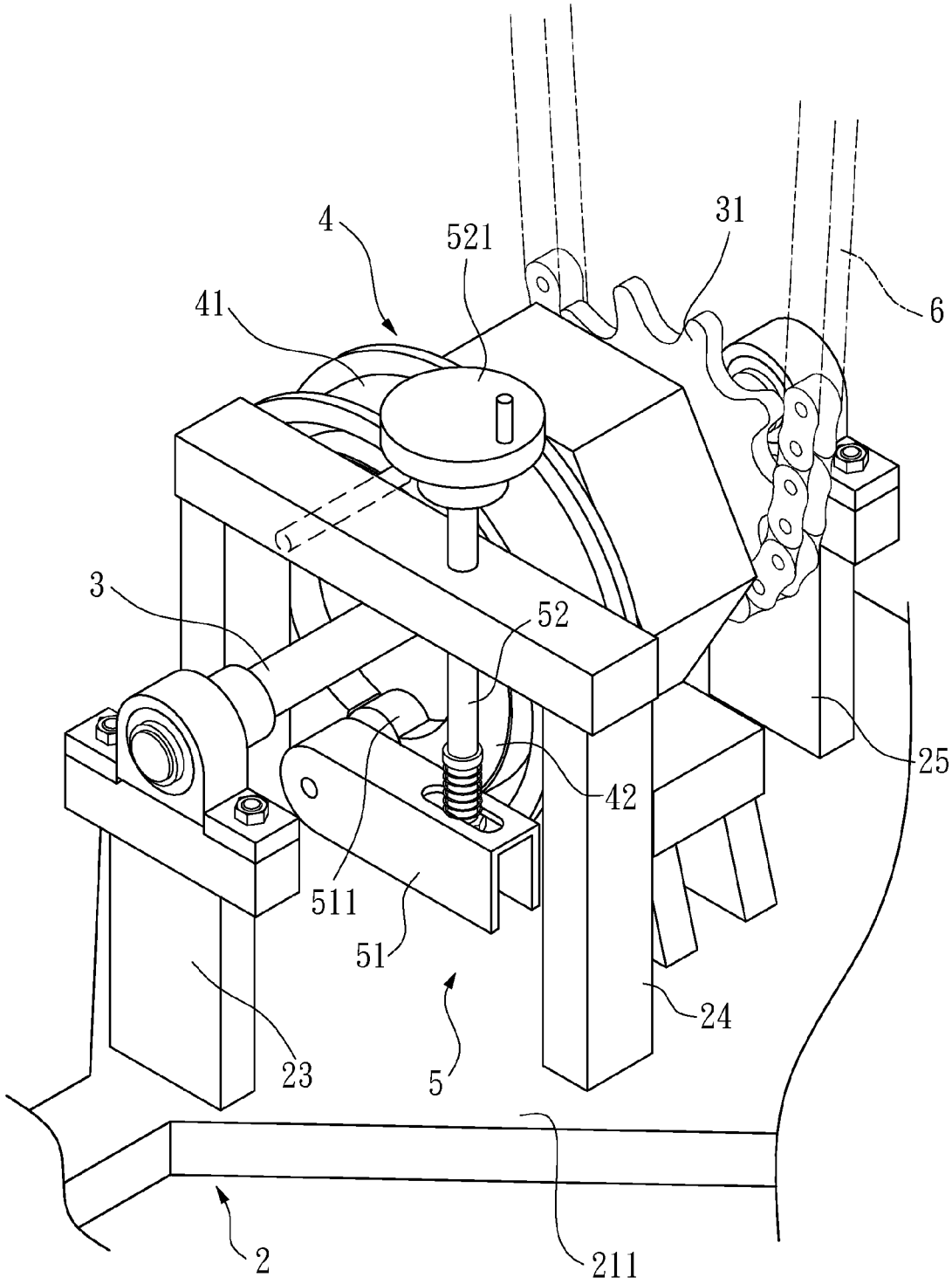
FIG. 4 shows the damping unit and the adjustment unit of the rock climbing practice device of the present invention.
Figure 5:
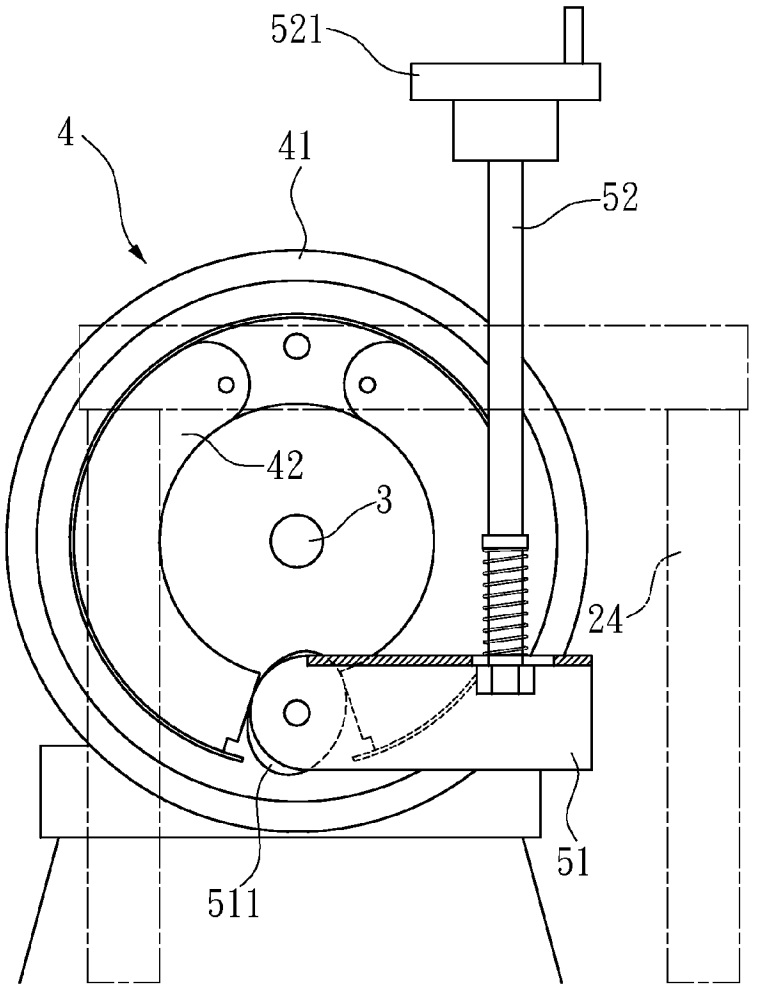
FIGS. 5 and 6 show that the adjustment portion of the adjustment unit is rotated by operation of the adjustment unit.
Figure 6:
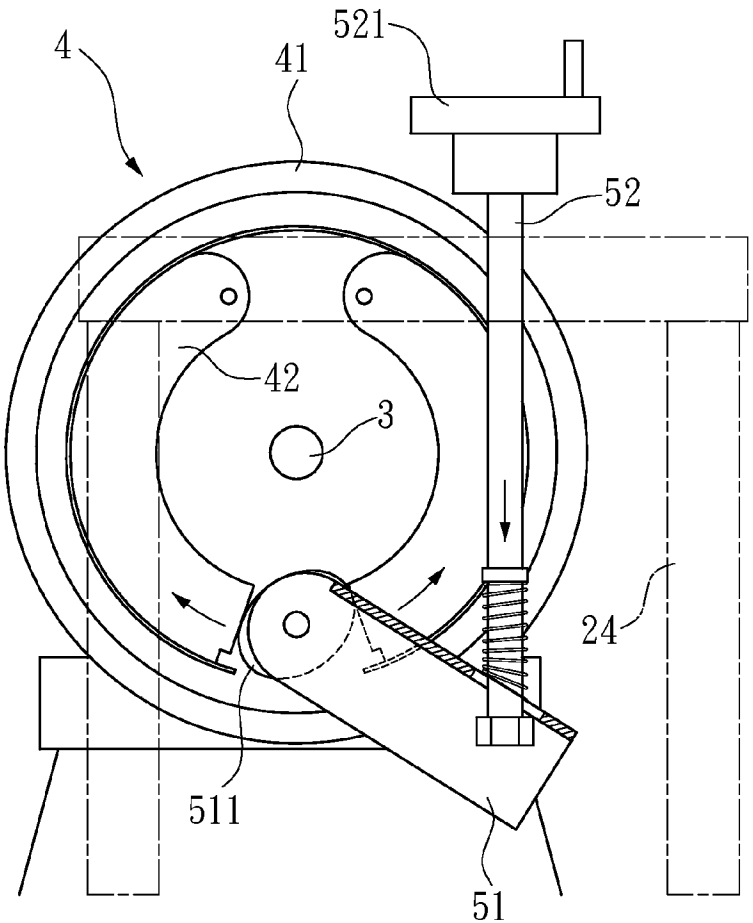

Referring to FIGS. 1 to 6, the rock climbing practice device 1 of the present invention comprises a body 1 having multiple climbing surfaces 11A and side surfaces 11B and an angle θ is defined between adjacent climbing surfaces 11A/side surfaces 11B so as to form a three dimensional body. An axle 15 extends through two opposite sides of the body 1 and along a short axis "A" of the body 1 and multiple climbing holds 12 are connected to the climbing surfaces 11A. The climbing surfaces 11A are formed along a rotational direction of the body. The body 1 can be rotated 360 degrees about the axle 15 (axis "A").

The body 1 is composed of multiple cubic units 13 and includes four climbing surfaces 11A and two side surfaces 11B. Each cubic unit 13 has a board 14 fixed on a side thereof and the boards 14 define the climbing surfaces 11A and the side surfaces 11B. The climbing holds 12 are connected to the boards 14 of the climbing surfaces 11A.

A support unit 2 supports the axle 15 and the body 1 is rotatable 360 degrees about the axle 15 relative to the support unit 2. The support unit 2 includes a base portion 21 and two sub-portions 26 between which the base portion 21 is connected. The base portion 21 includes a substantially rectangular frame 212 put on the floor or ground and three support rods 22 extend from a triangular board 211 on each of the sub-portions 26 of the support unit 2. The body 1 is located between the two sub-portions 26 of the support unit 2 and two ends of the axle 15 are rotatably supported on the support rods 22 of the two the sub-portions 26. The base portion 21 of the support units 2 includes a first post 23 and a second post 25, and a shaft 3 is connected between the first and second posts 23, 25, and co-rotated with the axle 15. A damping unit 4 is connected to the shaft 3 and an adjustment unit 5 is connected to the damping unit 4.

The shaft 3 is supported between the first and second posts 23, 25 and two gears 151, 31 are connected to the axle 15 and the shaft 3 respectively. A chain 6 is connected between the two gears 151, 31 so that the axle 15 and the shaft 3 are co-rotated.

The body 1 rotates when climber climbs the body 1 and the weight of the climber applies a torque to rotate the body 1 about the axle 15.

The damping unit 4 includes a rotating disk 41 connected to the shaft 3 and two braking drums 42. The braking drums 42 each have a first end pivotably connected to a fixed portion and located at an inner periphery of the rotating disk 41. Two respective second ends of the braking drums 42 have a gap located therebetween. When the two braking drums 42 are pivoted, the braking drums are in contact with a skirt portion of the rotating disk 41 to apply a damping/friction force to the rotating disk 41. The two braking drums 42 are controlled by the adjustment unit 5 so as to provide a damping force to the body 1.

The adjustment unit 5 includes an arm 51 and an activation portion 511 is connected to a first end of the arm 51. The activation portion 511 is an oval piece and located between the two second ends of the two braking drums 42. An adjustment rod 52 is pivotably connected to a second end of the arm 51 and threadedly extends through a third post 24. An operation wheel 521 is connected to a top end of the adjustment rod 52 so as to rotate and move the adjustment rod 52. The adjustment rod 52 pivots the arm 51 to change a position of a long axis of the activation portion 511 so as to pivot the two braking drums 42 to contact the rotating disk 41.

Figure 7:
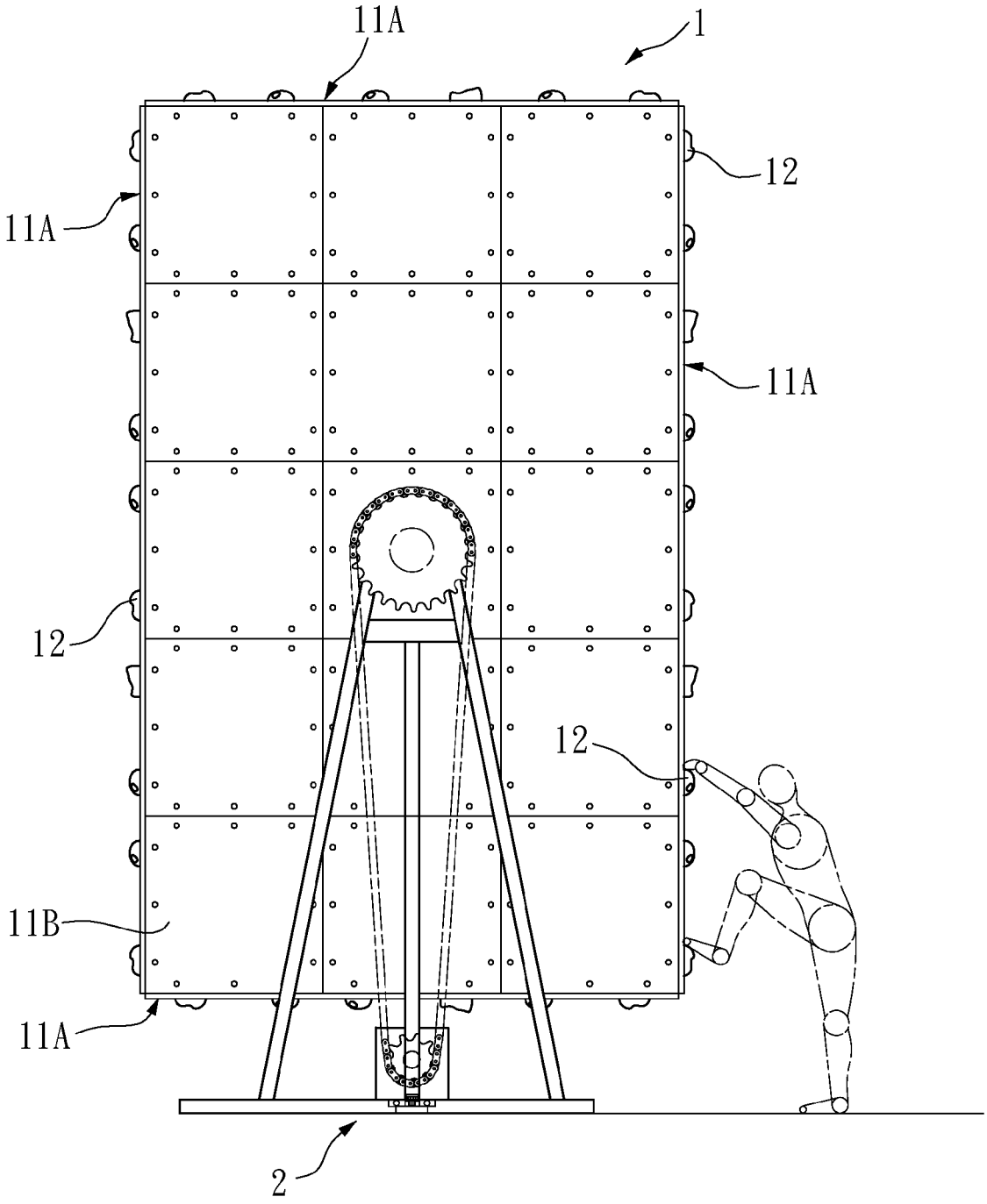
FIG. 7 shows a climber begins to climb one climbing surface of rock climbing practice device of the present invention.
Figure 8:
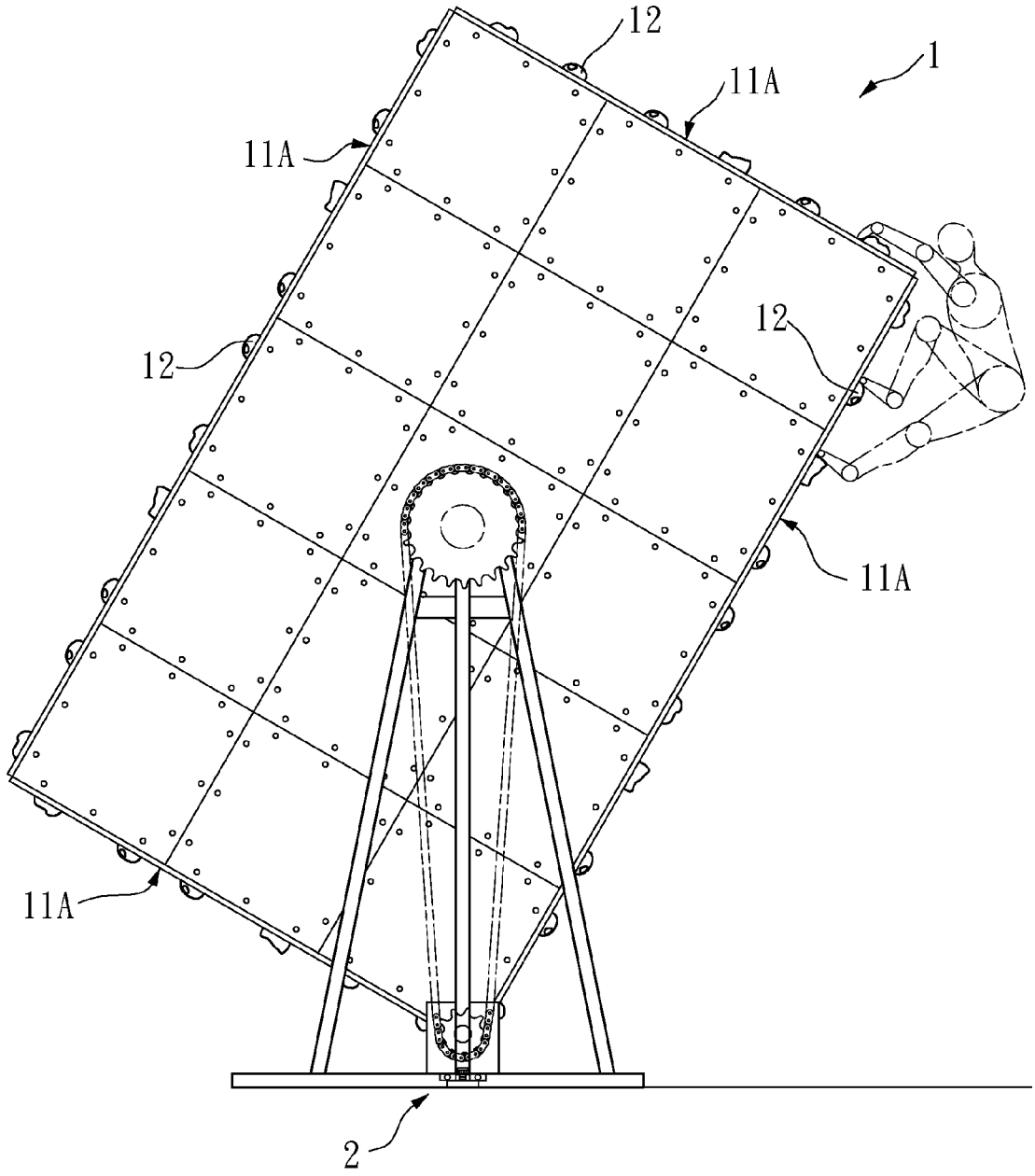
FIG. 8 shows a climber climbs the body from one climbing surface to another climbing surface.

As shown in FIGS. 7 and 8, the climber can choose one of the climbing surfaces 11A to climb the body 1 and the body rotates due to the weight of the climber so that the climber has to use different skill to gradually climb to the top of the body 1 while the climbing surface 11A is inclined. When the climber climbs to the top of that climbing surface 11A, he or she can climb to the adjacent climbing surface 11A as shown in FIG. 8.

Figure 9:
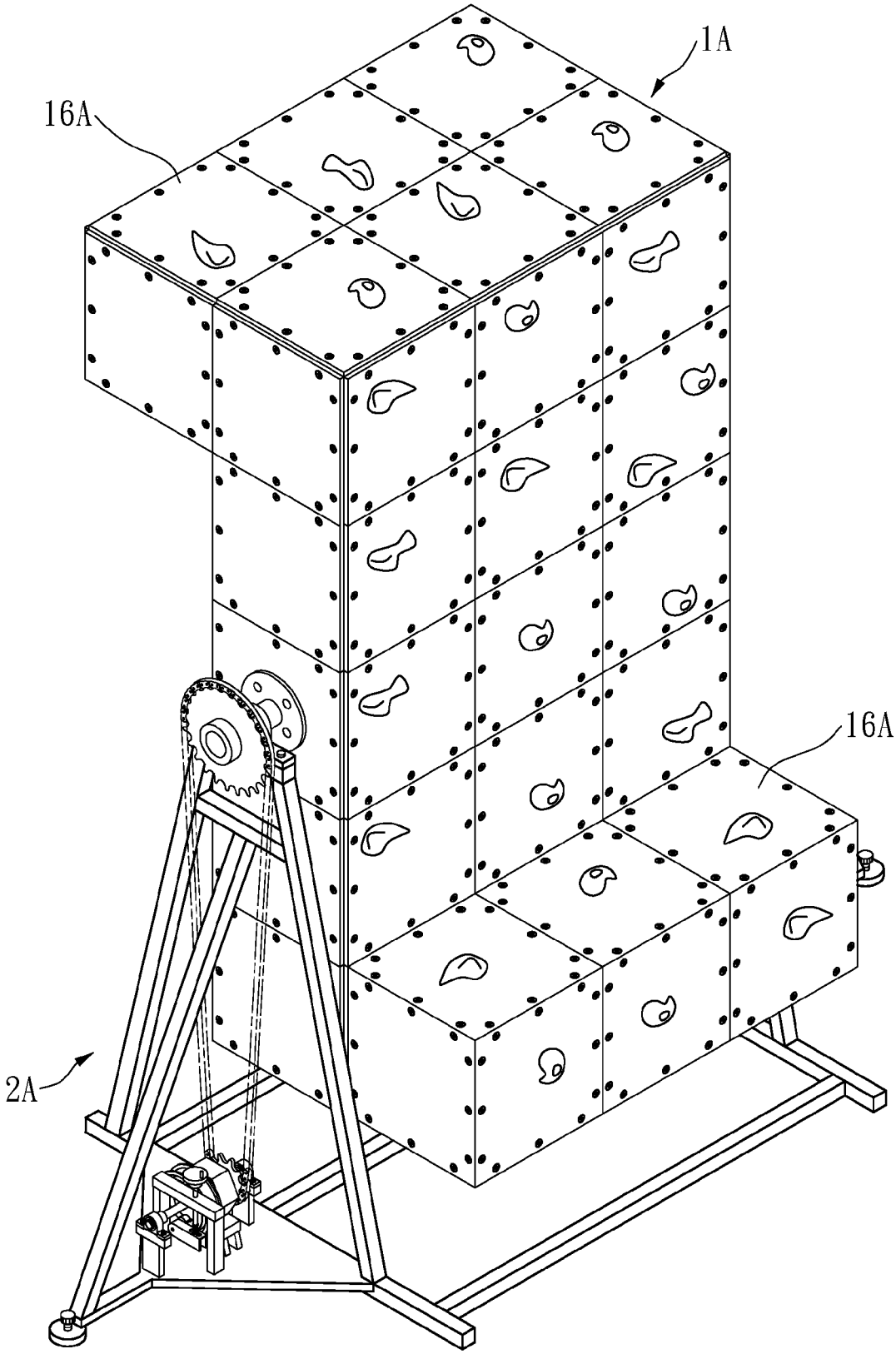
FIG. 9 shows a second embodiment of the body of rock climbing practice device of the present invention.

The body 1 can be any shape and a second embodiment of the body 1A is shown in FIG. 9, wherein the body 1A is a rectangular body and two first protrusions 16A extend from two opposite directions from two ends of a long axis of the body 1A. The axle 15 extends through a short axis of the body 1A and is supported on the support unit 2A.

Figure 10:
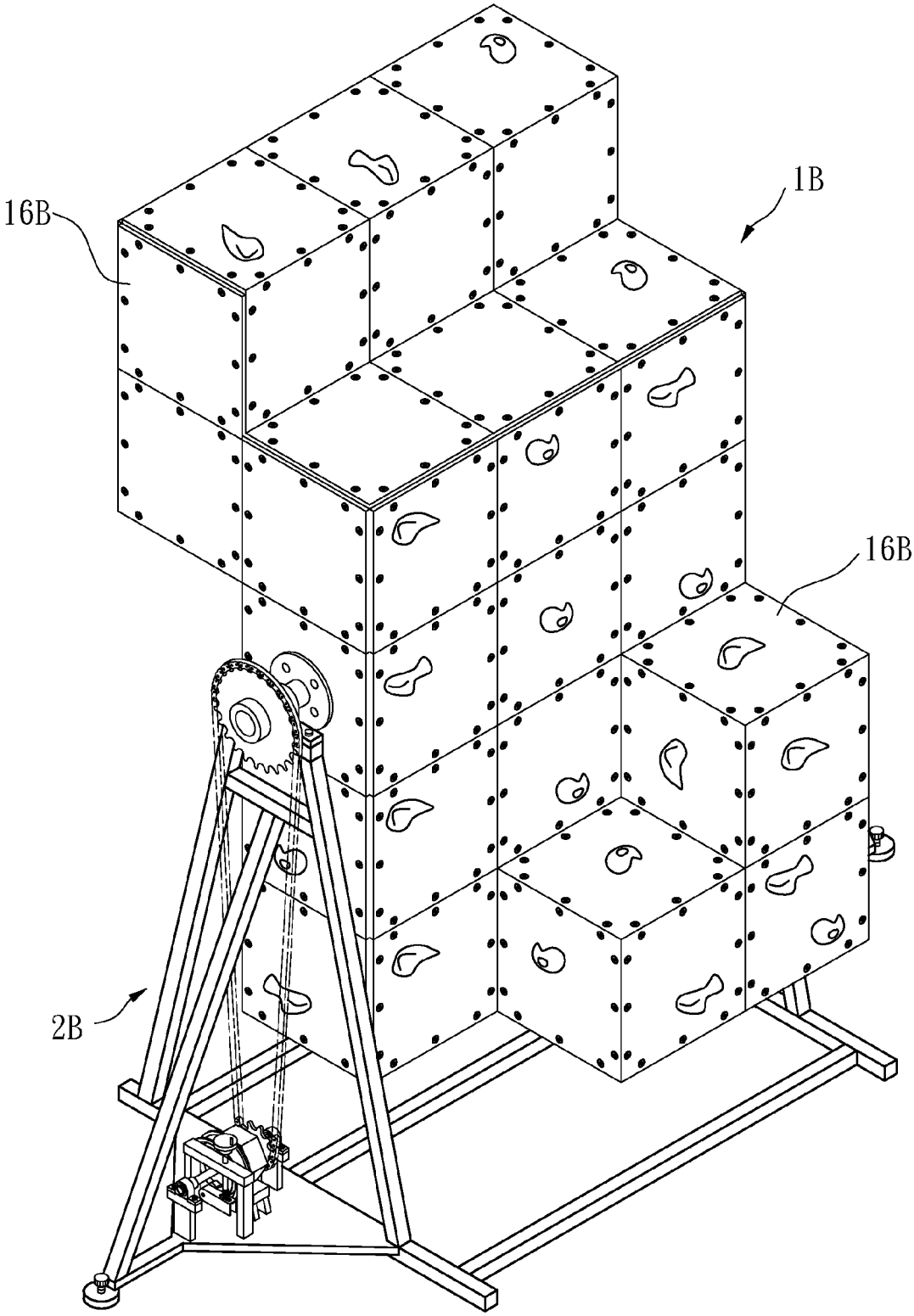
FIG. 10 shows a third embodiment of the body of rock climbing practice device of the present invention.
Figure 11:
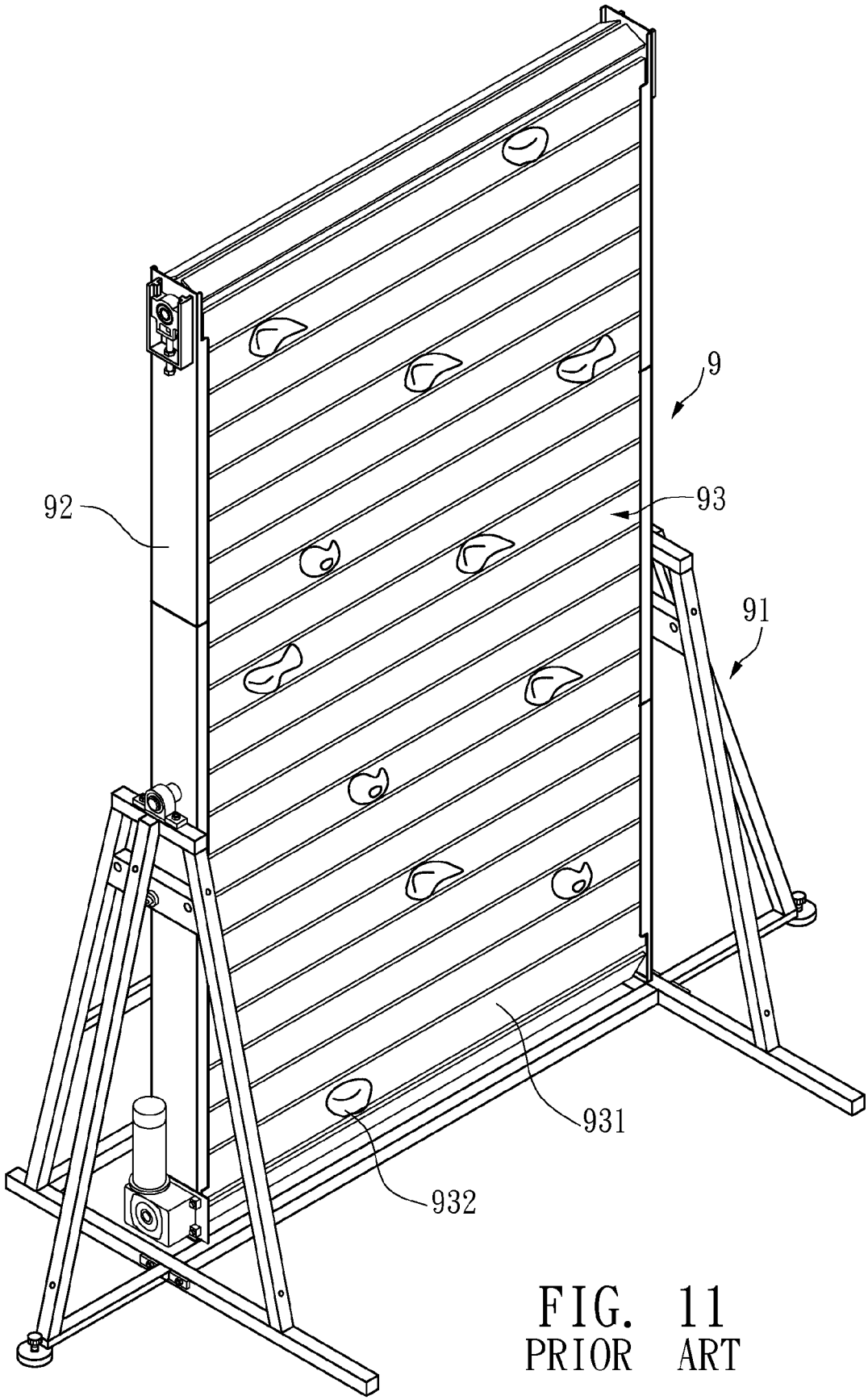
FIG. 11 PRIOR ART
FIG. 11 shows a conventional rock climbing practice device.

The body 1B can also be the one as shown in FIG. 10, the third embodiment, a rectangular body and two second protrusions 16B extend from two opposite directions from two ends of a long axis of the body 1B. The axle 15 extends through a short axis of the body 1B and is supported on the support unit 2B. The second protrusions 16B each have multiple sub-protrusions.

While we have shown and described the embodiment in accordance with the present invention, it should be clear to those skilled in the art that further embodiments may be made without departing from the scope of the present invention.

What is claimed is:

1. A rock climbing practice device comprising:

a body having multiple climbing surfaces and side surfaces, an angle defined between adjacent climbing surfaces/side surfaces so as to form a three dimensional body, an axle extending through two opposite sides of the body and multiple climbing holds connected to the climbing surfaces which are formed along a rotational direction of the body; and a support unit supporting the axle and wherein the body is rotatable 360 degrees about the axle relative to the support unit, wherein the body is composed of multiple cubic units and includes four climbing surfaces and two side surfaces, each cubic unit has a board fixed on a side thereof and the boards define the climbing surfaces and the side surfaces, the climbing holds are connected to the boards of the climbing surfaces, the axle extends through a short axis of the body.

2. The device as claimed in claim 1, wherein the support unit includes a base portion and two sub-portions between which the base portion is connected, three support rods extend from each of the two sub-portions, the body is located between the two sub-portions and two ends of the axle are rotatably supported on the support rods of the two sub-portions.

3. The device as claimed in claim 1, wherein a shaft is connected to the support unit and co-rotated with the axle, a damping unit is connected to the shaft and an adjustment unit is connected to the damping unit.

4. The device as claimed in claim 2, wherein each of the sub-portions of the support unit has a first post and a second post, a shaft is supported between the first and second posts, two gears are connected to the axle and the shaft respectively and a chain is connected between the two gears.

5. The device as claimed in claim 3, wherein the damping unit includes a rotating disk connected to the shaft and two braking drums, the braking drums are controlled by the adjustment unit to contact the rotating disk to provide damping force.

6. The device as claimed in claim 5, wherein the adjustment unit includes an arm and an activation portion is connected to a first end of the arm, the activation portion is an oval piece and located between two ends of the two braking drums, an adjustment rod is pivotably connected to a second end of the arm and threadedly extends through a third post, an operation wheel is connected to a top end of the adjustment rod so as to rotate and move the adjustment rod, the adjustment rod pivots the arm to change a position of a long axis of the activation portion so as to pivot the two braking drums to contact the rotating disk.

* * * * *